United States Patent [19]

Kobayashi

[11] Patent Number: 4,830,377

[45] Date of Patent: May 16, 1989

[54] GOLF CLUB

[75] Inventor: Masashi Kobayashi, Matsudo, Japan

[73] Assignee: Maruman Golf Co., Ltd., Tokyo, Japan

[21] Appl. No.: 99,462

[22] Filed: Sep. 21, 1987

[30] Foreign Application Priority Data

Sep. 29, 1986 [JP] Japan ..... 61-228467

[51] Int. Cl.[4] ..... A63B 69/36

[52] U.S. Cl. ..... 273/186 A

[58] Field of Search ..... 273/186 A

[56] References Cited

U.S. PATENT DOCUMENTS

| | | | |
|---|---|---|---|
| 3,792,863 | 2/1974 | Evans | 273/186 A |
| 3,806,131 | 4/1974 | Evans | 273/186 A |
| 3,945,646 | 3/1976 | Hammond | 273/186 A |
| 4,239,227 | 12/1980 | Davis | 273/186 A |
| 4,453,716 | 6/1984 | Oppenheimer | 273/186 A |
| 4,515,368 | 5/1985 | Petitjean | 273/186 A |
| 4,693,479 | 9/1987 | McGuire | 273/186 A |

FOREIGN PATENT DOCUMENTS

| | | | |
|---|---|---|---|
| 55-125369 | 9/1980 | Japan . | |
| 55-113473 | 9/1980 | Japan . | |
| 56-51884 | 12/1981 | Japan . | |
| 2126104 | 3/1984 | United Kingdom | 273/186 A |

*Primary Examiner*—Leonard E. Smith
*Assistant Examiner*—Eugene L. Szczecina, Jr.
*Attorney, Agent, or Firm*—Armstrong, Nikaido, Marmelstein, Kubovcik & Murray

[57] ABSTRACT

A golf club comprises a strain gauge attached to a surface of a hollow shaft in the vicinity of a kick point for detecting a bending of the shaft and a sound indicator for generating a sound when a strain of the shaft, particularly at the kick point, exceeds a predetermined level, so that a golf player can easily confirm whether or not sufficient force is exerted on the shaft during the downswing motion.

2 Claims, 2 Drawing Sheets

GOLF CLUB

BACKGROUND OF THE INVENTION

1. Field of the Invention

This invention relates to a golf club and, more particularly, to a golf club which is advantageously used for practicing a swing movement.

2. Description of the Related Art

A golf club comprises a club head, a hollow shaft and a grip. Generally speaking, when a wood or iron club is used and a swing movement is conducted therewith, the hollow shaft is pliably bent due to the inertia force of the club head during the downswing motion, and returned to a straight status, usually, at a moment of impact with a ball. If the downswing motion is conducted in such a manner that the shaft is pliably bent to the largest extent immediately after the downswing motion is started, the speed of the club head becomes the highest at the moment of ball impact. If, however, less force is exerted on the golf club immediately after the downswing motion is started, the value of strain is less, so that the speed of the club head becomes lower at the ball impact. Similarly, if the timing at which a large force to exerted on the golf club is late during the downswing motion, the timing at which the shaft is returned to a straight status becomes inconsistent with the ball impact timing in such cases, sufficient kinetic energy may not be given to the golf ball, or the ball may travel in an undesired direction.

A golf club shaft having a grip which is provided with a strain gauge for detecting a torsion of the grip portion is known in the prior art, as disclosed in Japanese Unexamined Utility Model Publication No. 55-125369. However, in this golf club, the strain of the shaft itself during the downswing movement thereof cannot be detected.

SUMMARY OF THE INVENTION

An object of the present invention is to provide a golf club capable of easily indicating how and when a force is exerted thereto after the downswing motion is started.

According to the present invention, there is provided a golf club comprising a club head, a grip, and a shaft extending from said club head to the grip; said golf club further comprising means for detecting a strain of said shaft and outputting an electric signal corresponding to a pliable bending of the shaft, and a sound indicator for generating a sound when the electric signal exceeds a predetermined level.

When using a golf club of the present invention, if the player conducts the downswing motion in such a manner that the shaft is pliably bent to a certain extent, so that the strain of the golf shaft exceeds a predetermined level, the sound indicator generates an indicating sound, and thus the player can confirm how and when the most force is exerted to the golf shaft, while practicing golf.

DESCRIPTION OF THE PREFERRED EMBODIMENTS

Figure 1:
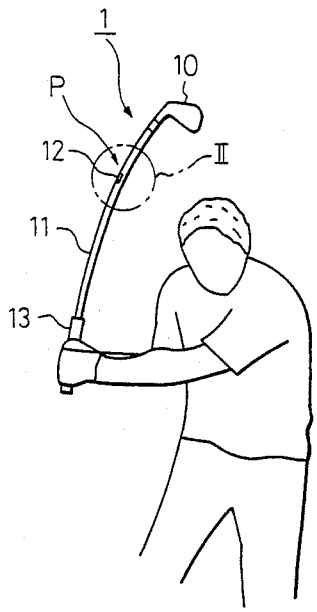
FIG. 1 is a schematic perspective view illustrating a golf club according to the present invention in a downswing movement.
Figure 2:
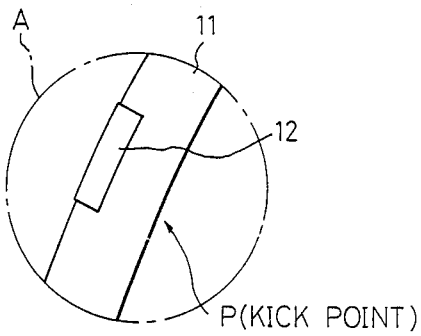
FIG. 2 is an enlarged view of a portion denoted by II in FIG. 1 and illustrating a part of a club shaft.

Referring now to the drawings, FIGS. 1 through 4 illustrate an embodiment of a golf club according to the present invention. In FIGS. 1 and 2, a golf club 1 comprises a head 10, a hollow shaft 11 and a grip 13. The shaft 11 is provided with a strain sensor, such as a strain gauge 12, which is conventionally known per se, on the shaft surface in the vicinity of a kick point P, at which the shaft 11 is most pliably bent during the downswing motion of the golf club. The strain gauge 12 is generally a sheet-type and advantageously attached to the shaft surface in the vicinity of the kick point P, extending parallel to the shaft axis and on the shaft facing in a direction substantially perpendicular to the face of the club head 10 and arranged in the longitudinal direction so that the strain gauge 12 detects the longitudinal strain of the golf shaft 11.

Figure 3:
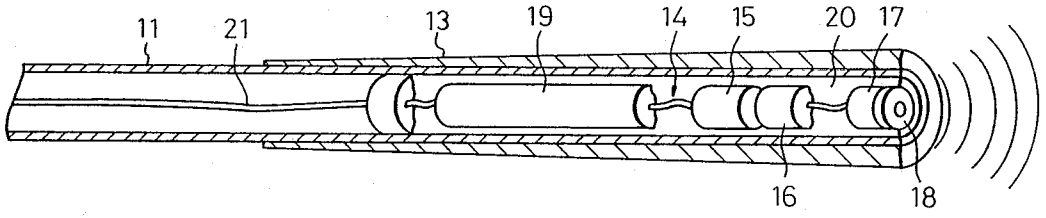
FIG. 3 is cross-sectional view of a part of a hollow shaft and illustrating a sound indicator provided in the hollow shaft; and, FIG. 4 is a block diagram illustrating several elements which constitute the sound indicator.

As shown in FIG. 3, a sound indicator 14 is provided in an interior of the hollow shaft 11 in the grip 13. The sound indicator 14 comprises an amplifier 15, a trigger 16, an oscillator 17, a sound generator 18, and a batter 19. These elements are immovably accommodated in the hollow shaft 10 by a molded member 20. The above-mentioned strain gauge 12 is electrically connected to the sound indicator 14 via a lead line 21 extended through the interior of the shaft 11.

Figure 4:
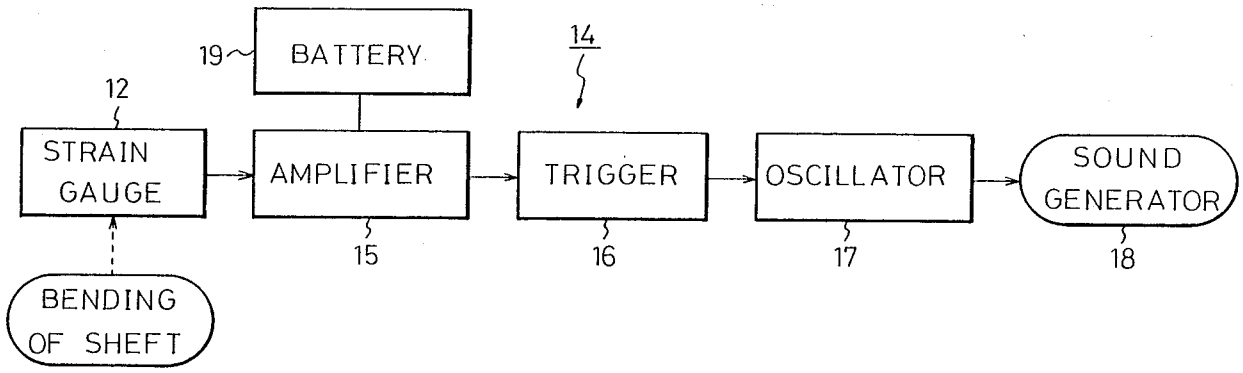

FIG. 4 illustrates a block diagram of the sound indicator 14. The resistance value of the strain gauge 12 changes in accordance with the strain on the shaft 11. That is, the strain gauge 13 outputs an electric signal corresponding to the longitudinal strain of the golf shaft 11, particularly at the kick point P. The output signal is supplied to the amplifier 15, in which the signal is amplified. Then, the amplified signal is fed to the trigger 16, at which the signal is triggered in such a manner that, if the amplified signal exceeds a predetermined level, a control signal is supplied to the oscillator 17. When receiving the control signal, the oscillator 17 generates a signal with a predetermined frequency during a predetermined time period. Thus, at the sound indicator 18, the electric signal is converted to an indicating sound, which can be heard by the golf player.

It is should be noted that the predetermined value of the strain can be desirably set or adjusted in accordance with the player's experience in golf, physical strength, and the like, or the kind of golf club, or practice conditions. This can be done, in the trigger 16, by appropriately setting or changing the reference value (trigger value) which is compared with the input amplified signal.

In a golf club having a construction as mentioned above, when the golf shaft 11 is pliably bent during the downswing motion, and if the strain on the shaft 11, particularly at the kick point P thereof, exceeds the above-mentioned predetermined value, an indicating sound is generated. The sound can, of course, be heard by the golf player, so that, upon hearing such a sound during the downswing moment and confirming whether or not such a sound is generated, the player becomes aware of whether and when a kinetic energy more than a certain level is exerted to the shaft during the downswing movement of the shaft.

Therefore, the player can easily confirm whether or not sufficient force is exerted on the golf shaft during the downswing motion. In addition, the player can also easily confirm whether the timing at which the strongest force is exerted on the shaft is appropriate or not.

When the reference value is to be set or changed in the trigger 16, the sound indicator 14 may be removed from the club shaft 11. However, desirably a suitable adjuster (not shown) is provided on, for example, a top end of the grip 13 of the club shaft 11, to more easily conduct such a setting or changing of the trigger value without removing the sound indicator 14.

I claim:

1. A golf club, comprising: a club head, a grip portion, and a hollow shaft extending from said club head through said grip portion and having a kick point between said club head and said grip portion at which the shaft is most pliably bent during a downswing motion of the golf club, wherein said golf club further comprises a strain gauge attached to a surface of said shaft substantially at said kick point and extending substantially parallel to the shaft axis and on said shaft surface facing in a direction substantially perpendicular to the face of said club head, for detecting a strain of said shaft by the pliable bending of said shaft at said kick point and for outputting an electric signal corresponding to said pliable bending of said shaft, a sound indicator completely within said hollow shaft and completely within said grip portion for generating a sound when an electric signal outputted from said stain gauge exceeds a predetermined level, and a lead line completely within said hollow portion for transmitting said electric signal from said strain gauge to said sound indicator.

2. A golf club as set forth in claim 1, wherein said sound indicator comprises an amplifier for amplifying said electric signal from said strain gauge, an oscillator for generating a reference signal with a predetermined frequency, a trigger for actuating said oscillator when a level of the signal amplified by said amplifier exceeds a predetermined level, and a sound generator for converting said signal of the oscillator to an audible sound.

* * * * *